United States Patent [19]

Dennis

[11] Patent Number: 4,886,237

[45] Date of Patent: Dec. 12, 1989

[54] UNIVERSAL ARTICULATABLE SUPPORT FOR RETAINING INTRAVENOUS STANDS IN MEDICAL APPLICATIONS

[76] Inventor: Robert R. Dennis, 4402 MacWorth Pl., Baltimore, Md. 21236

[21] Appl. No.: 248,146

[22] Filed: Sep. 23, 1988

[51] Int. Cl.[4] ..... A47F 5/00

[52] U.S. Cl. ..... 248/289.1; 248/316.5

[58] Field of Search ..... 248/231.4, 285, 289.1, 248/231.5, 316.5; 5/503, 508; 280/289 WC; 604/93; 128/DIG. 26

[56] References Cited

U.S. PATENT DOCUMENTS

| | | | |
|---|---|---|---|
| D. 221,366 | 8/1971 | Saternus | D83/1 |
| 606,871 | 7/1898 | Manning | 248/289.1 |
| 801,940 | 10/1905 | Walker | 248/289.1 |
| 1,162,608 | 11/1915 | Hohl | 248/285 X |
| 1,213,262 | 1/1917 | Roginski | 248/289.1 |
| 2,696,963 | 12/1954 | Shepherd | 5/503 X |
| 2,954,955 | 10/1960 | Feller | 248/285 X |
| 2,957,187 | 10/1960 | Raia | 5/503 |
| 3,337,880 | 8/1967 | Florek | 5/503 |
| 3,398,919 | 8/1968 | Tokar | 5/503 X |
| 3,709,372 | 1/1973 | Alexander | 5/503 X |
| 3,709,556 | 1/1973 | Allard | 248/125 X |
| 3,739,943 | 6/1973 | Wilhelmson et al. | 222/59 |
| 3,835,486 | 9/1974 | Benoit | 5/503 |
| 4,038,981 | 10/1977 | LeFevre et al. | 128/214 |
| 4,332,378 | 6/1982 | Pryor | 248/125 X |
| 4,511,157 | 4/1985 | Wilt | 248/125 X |
| 4,511,158 | 4/1985 | Varga et al. | 280/292 |
| 4,600,209 | 7/1986 | Kerr | 5/503 X |
| 4,690,674 | 9/1987 | Dalglish | 5/503 X |
| 4,768,241 | 9/1988 | Beney | 5/503 X |

*Primary Examiner*—J. Franklin Foss

*Attorney, Agent, or Firm*—Leonard Bloom

[57] ABSTRACT

A device for attaching a column of an intravenous stand to a frame of a patient support apparatus comprises a bracket attached to the frame, a bar mounted in the bracket and a clamping means on the second end of the bar. The bar may be folded substantially flat against the frame and it may be extended outwardly to at least one position. Preferably, the brakcet has an arcuate slot therein with a threaded bolt passing therethrough to engage the bar. The bar may be extended approximately 180° and secured in all desired intermediate positions therebetween. The clamping means is a clip hingably connected to the second end of the bar with an intermediate portion and a second end. The intermediate portion has a configuration complementary to the column of the intravenous stand. A spring latch is mounted on the bar adjacent to the clip. The spring latch has a latch hook to engage the hook on the clip. When so engaged, the intermediate portion encompasses the column of the stand and is clamped in place thereby supporting the intravenous stand on the patient support device and preventing inadvertent movement of the intravenous stand during use thereof. In another embodiment, the bar is telescoping and adjustable in length.

14 Claims, 6 Drawing Sheets

UNIVERSAL ARTICULATABLE SUPPORT FOR RETAINING INTRAVENOUS STANDS IN MEDICAL APPLICATIONS

FIELD OF THE INVENTION

This invention relates to a device for support of an intravenous stand to a patient support apparatus or the like which provides stability to the stand and improved flexibility of use.

BACKGROUND OF THE INVENTION

Intravenous (IV) stands are in common use in hospitals, nursing home and facilities in which patients must receive fluids while in beds or in transport. These stands frequently are a base with wheels and a stand projecting vertically to a height above the patient, for attachment of the fluid containers to permit gravity flow of the fluid. This configuration is not very stable since the stand can be rolled away from the patient unintentionally while the connecting tubes are still attached to the patient. Also the stand with the fluid container elevated above the patient is top heavy and can topple. A further problem is the difficulty in transporting the patient and having to move the IV stand synchronously with the patient transport (e.g. bed or gurney). This is especially important in critical care units where the patient requiring intravenous infusion has been placed in a bed and must be moved while still in the same bed. However, it is also needed in a hospital room where the patient is not being transported but still requires a stable IV stand which can be easily moved to provide unimpeded access to the patient. To overcome these problems, means for attaching the upright stand to the patient support have been designed. These include a rigid connector between the IV stand and the bed so that both can be rolled together, e.g. U.S. Pat. No. 4,511,157 issued to Wilt, Jr., U.S. Pat. No, 4,511,158 issued to Varga et al and U.S. Pat. No. 4,600,209 issued to Kerr, Jr. and various means for attaching the upright member of the IV stand to the patient support device, e.g. U.S. Pat. No. 2,696,963 issued to Shepherd, U.S. Pat. No. 3,709,372 issued to Alexander and U.S. Pat. No. 3,739,943 issued to Wilhelman et al and U.S. Pat. No. 3,337,880 issued to Florek. The latter designs frequently interfere with access to the patient by the medical staff and are fixed in place, thereby limiting their utility.

A need exists for a simple device which can be attached to both the patient support apparatus and the upright column of an intravenous stand while permitting the intravenous stand to be stably placed in any desired position with relation to the patient. The device should also be capable of being stored without interfering with access to the patient.

SUMMARY OF THE INVENTION

A principal object of this invention is to provide a device for attaching the column of an intravenous stand to a patient support apparatus.

It is another object of this invention to provide a device for attaching the column of an intravenous stand to a patient support apparatus such that the stand is stably supported, cannot be inadvertently moved away from the patient, and can be easily moved together with the patient support apparatus.

It is yet another object of this invention to provide a device for attaching the column of an intravenous stand to a patient support apparatus such that the device can be folded flat against the patient support apparatus for storage when not in use and can be extended outwardly from the patient support apparatus when in use.

It is a further object of this invention that the device for attaching the column of the intravenous stand be extended approximately 180° from the storage position and be secured at all desired intermediate positions therebeween.

It is still another object of this invention to provide a device for releasably clamping the column of the intravenous stand to a patient support apparatus.

In accordance with the teachings of the present invention, there is disclosed a device for attaching a column of an intravenous stand to a frame means of a patient support apparatus or the like, comprising a bracket means attached to the frame means of the patient support apparatus, preferably by a flange substantially at right angles to the frame means. The bracket means extends outwardly and substantially horizontally. A bar having a first end and a second end is mounted, by the first end of the bar, to the bracket means, such that the bar may be folded substantially flat against the frame of the patient support apparatus in a storage position when not in use, and such that the bar may be extended to at least a first position outwardly therefrom when inuse. The second end of the bar is releasably clamped to the column of the intravenous stand, thereby supporting the intravenous stand on the patient support apparatus and preventing inadvertent movement of the intravenous stand during use thereof.

Preferably, the patient support apparatus is a bed, but the device is usuable on a wheelchair, a gurney or any other apparatus in which patient needing intravenous infusion of fluids may be lying or sitting.

In a preferred embodiment, the means for mounting the first end of the bar to the bracket means comprises the bar having an opening near the first end. The bracket means has a substantially arcuate slot therein. A bolt passes through the arcuate slot and is received in the opening in the bar such that the bar may be adjustably mounted approximately flat against the frame of the patient support apparatus and may be extended approximately 180° therefrom. The bar may be secured in all desired intermediate positions therebetween. The bolt may be threaded and may have a manually turnable head, such as a knurled knob or a wing head.

The releasable clamping means of the preferred embodiment comprises a spring clip having a first end and a second end. The first end is hingably connected to the second end of the bar, the clip extending laterally therefrom. The clip has a configuration complementary to the column of the intravenous stand, and the clip further has a hook on the second end. A spring latch is mounted on the second end of the bar adjacent to the spring clip. The latch has a latch hook to engage the hook on the spring clip thereby clamping the bar to the column of the intravenous stand. Persons skilled in the art will appreciate that the end of the clip may be a loop instead of a hook or the latch may have a loop instead of a latch hook in order to effect the clamping mechansim by a hook and loop mechanism. Also, other connecting means such as threaded clamps or spring holders may be used.

The bar may be a telescoping bar which is adjustable in length.

In a preferred embodiment, the means for releasably clamping the second end of the bar to the column of the intravenous stand comprises a spring clip having a first end, a second end, and an intermediate portion therebetween. The firs end is hingably connected to the second end of the bar, the clip extending laterally thereform. The intermediate portion has a configuration complementary to the column of the intravenous stand such that when the column of the intravenous stand is positioned adjacent to the second end of the bar, the spring clip may be hingedly disposed such that the intermediate portion of the clip encompasses the column of the intravenous stand and the second end of the clip extends substantially around the column. The clip further has a hook on the second end. A spring latch is mounted on the second end of the bar adjacent to the spring clip. The latch has a latch hook to engage the hook on the spring clip. The latch further has a pivotally attached member attached to the loop such that when the latch hook is engaged with the hook on the spring clip, the pivotally attached member may be positioned to clamp the spring clip about the column of the intravenous stand thereby supporting the intravenous stand on the paient support apparatus and prevening inadvertent movement of the intravenous stand during use thereof.

The clamp means may have a non-slip coating thereabouts such that the column of the intravenous stand is securely held in the clamp and damage, such as marring, of the intravenous stand is reduced. A non-slip coating, such as a high density foam rubber, applied to the surface of the clip which contacts the stand has been used satisfactorily.

In another embodiment, a device for attaching a column of an intravenous stand to a frame menas of a patient support apparatus or the like comprises a bar having a first end and a second end. Means are provided for mounting the first end of the bar to the frame means of the patient support apparataus such that the bar may be folded substantially flat against the frame of the patient support apparatus in a storage position when not in use. The bar may be extended to at least a first position outwardly therefrom when in use. The device also includes a means for releasably clamping the second end of the bar to the column of the intravenous stand, thereby supporting the intravenous stand on the patient support apparatus and preventing inadvertent movement of the intravenous stand during use thereof.

In still another embodiment, the bracket means are attached to the frame means of the patient support apparatus such as a gurney or stretcher by an adjustable clamping mechanism. The adjustable mechanism comprises a pair of slidably nested channel members each having a means for engaging the frame of the gurney. Means are provided for manually sliding the nested channel members such that the channel members may be extended or retracted to allow engaging the frame of the gurney. Means are also provided to attach the bracket means of the device to the channel member.

These and other objects and advantages of the present invention will become apparent from a reading of the following specification, taken in conjunction with the enclosed drawings.

DESCRIPTION OF THE PREFERRED EMBODIMENTS

Figure 1:
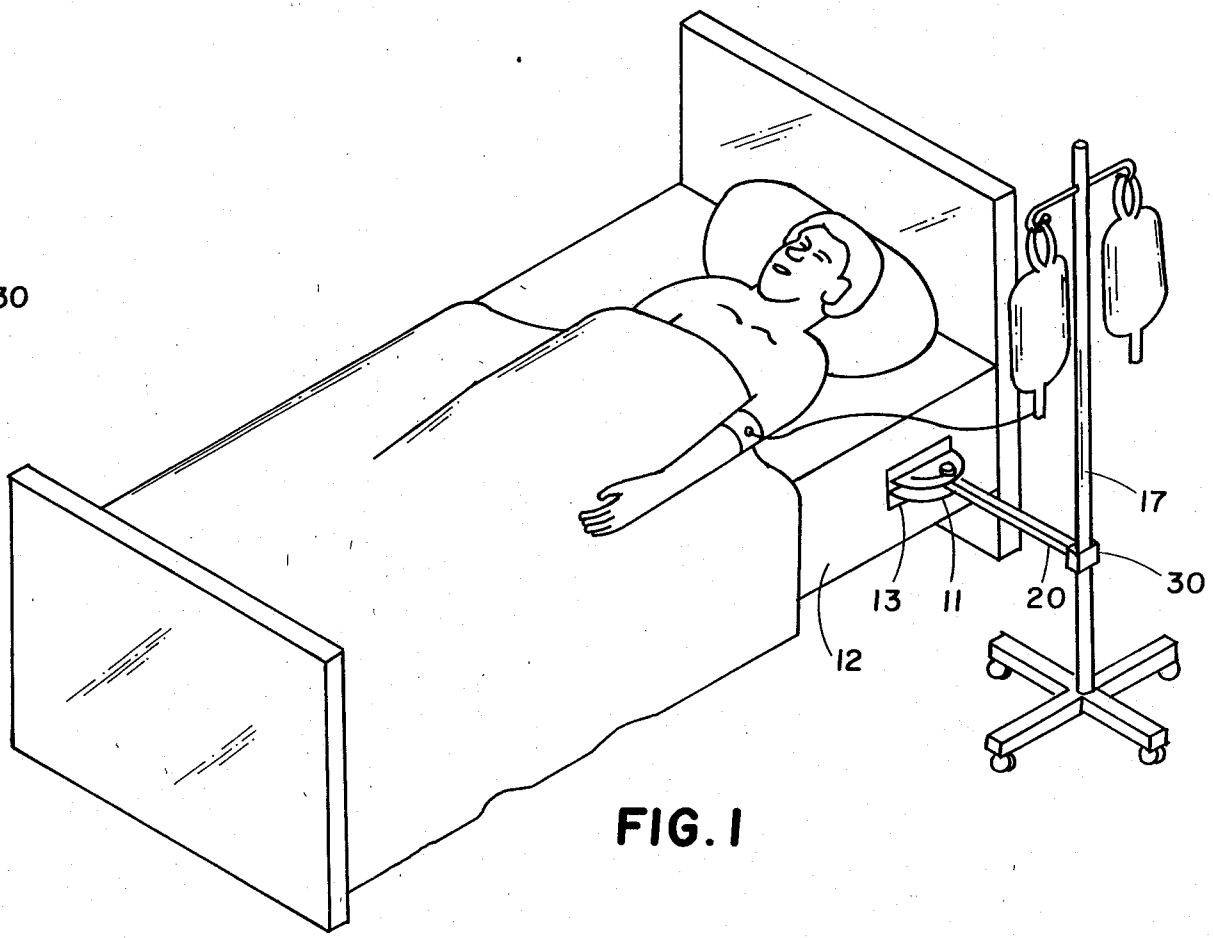
FIG. 1 is a perspective view showing a typical use of the intravenous stand attachment device attached to the frame means of a patient support apparatus.
Figure 14:
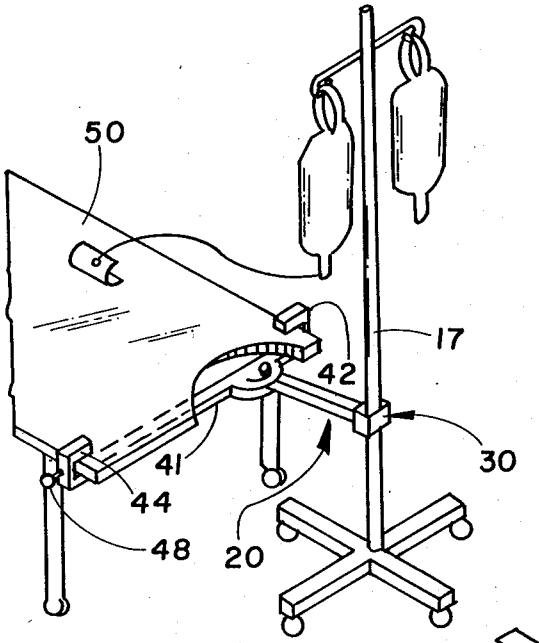
FIG. 14 is a perspective view of another embodiment of the device showing an adjustable clamping mechanism for mounting the device on a patient support apparatus such as a stretcher or gurney.
Figure 3:
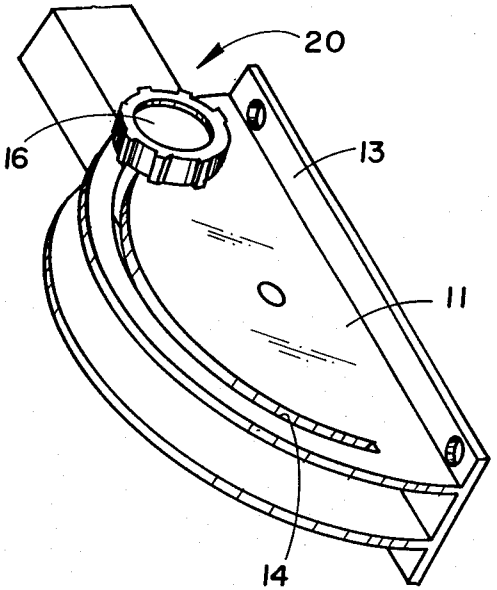
FIG. 3 is a perspective view of the intravenous stand device showing the storage position.
Figure 4:
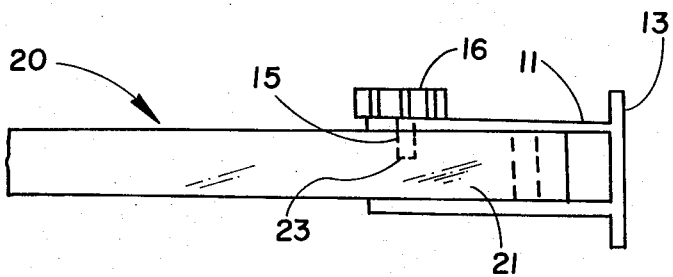
FIG. 4 is a cross-sectional view taken along section line 4—4 of FIG. 2 showing the bar disposed in the bracket.
Figure 2:
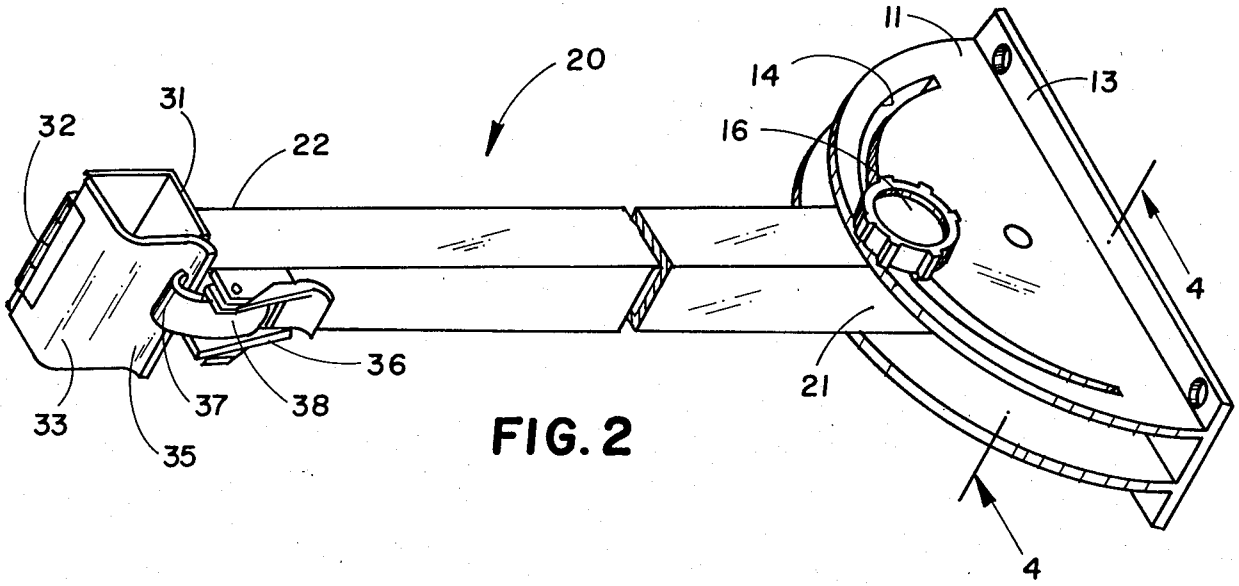
FIGS. 2 is a perspective view of the intravenous stand device showing the use position.
Figure 8:
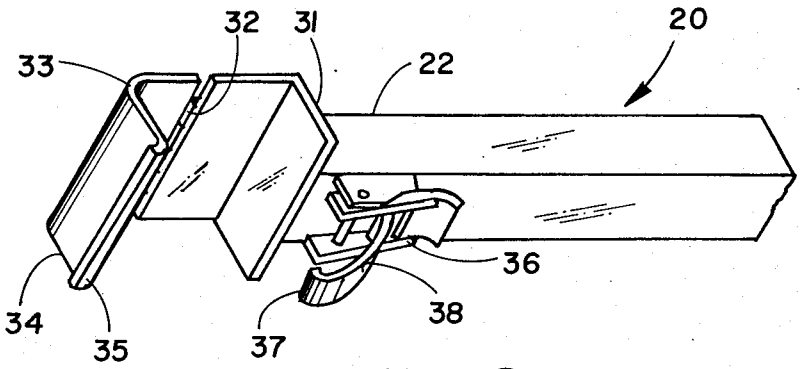
FIG. 8 is a top perspective view of the clamping means for the column of the intravenous stand showing both the clip and the latch.
Figures 5, 6, 7:
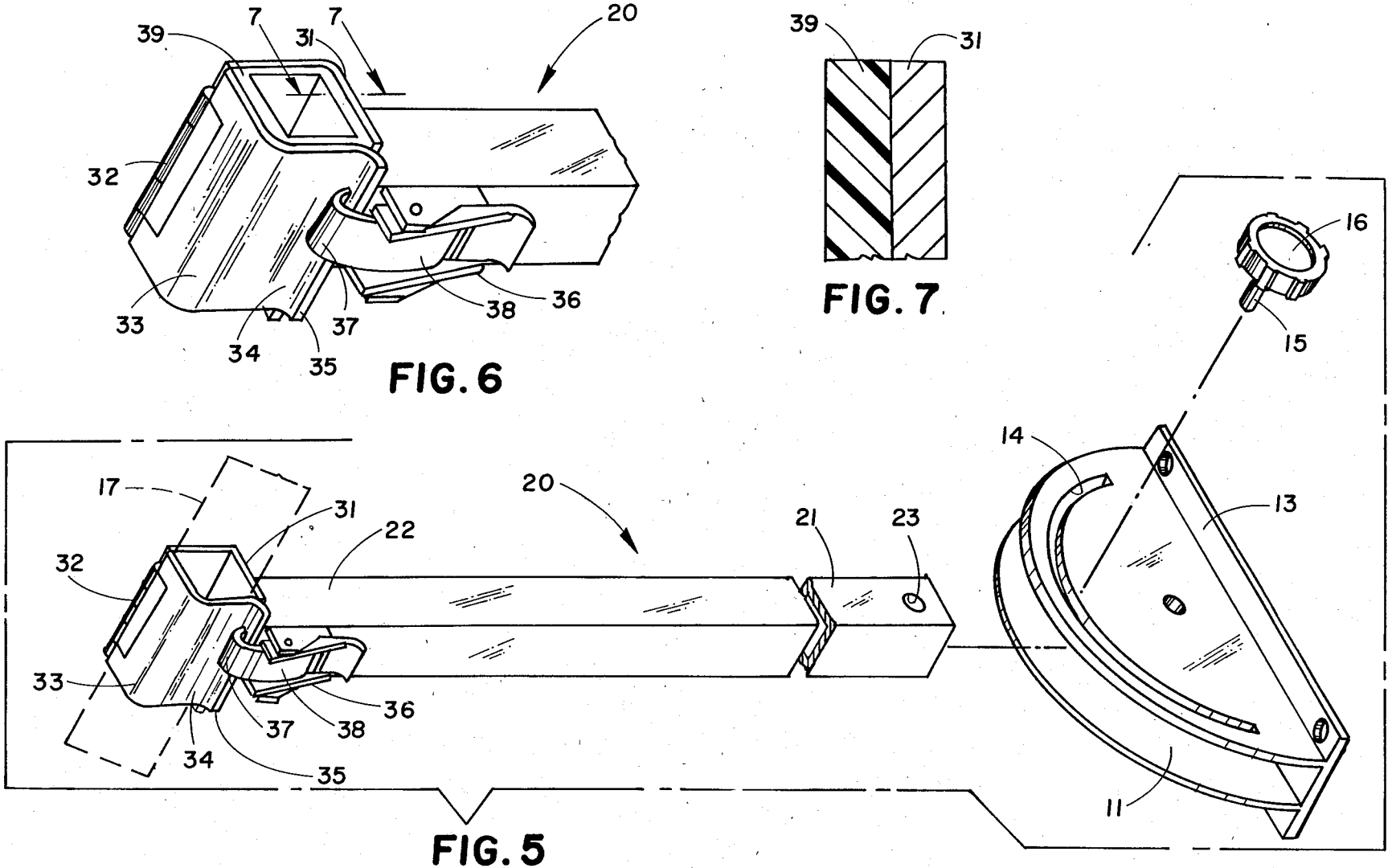
FIG. 5 is an exploded perspective view of the device showing the relative positioning of the members.
FIG. 6 is a detailed perspective view of the clamp mens showing the non-slip coating on the clamp means.
FIG. 7 is an enlarged cross-sectional view taken along section line 7—7 of FIG. 6 showing the non-slip coating on the clamp means.

Referring to the drawings, and as shown in FIG. 1, he device 10 of the present invention is shown in a typical use mode. As illustrated in FIGS. 2-6, the device 10 comprises a bracket means 11 mounted on the frame means 12 of a patient support apparatus by a flange 13 which is at substantially right angles to the bracket 11. Conventional means are used for attaching the flange 13 to the frame means 12. The bracket 11 has an arcuate slot 14 therein. The first end 21 of a bar 20 is mounted in the bracket 11, preferably by a pivotal mounting. Near the first end 21 of the bar 20, there is an opening 22. A bolt 15 passes through the arcuate slot 14 and is received in the opening in the bar 22. Preferably, the bolt 15 is threaded and has a head 16 such as a knurled knob or a wing head which can be manually turned. The bar 20 may be moved from a position approximately flat against the frame means 12 to at least one position outwardly therefrom. The arcuate slot 14 and bolt 15 permit extention of the bar through approximately 180° and all desired intermediate positions thereto. The bar can be secured in any desired intermediate position by adjustment of the bolt 15.

With reference to FIGS. 5–8, the device 10 further comprises a means for releasably clamping the column of the intravenous stand 17 to securely hold it and provide stability. In a preferred embodiment, a spring slip 30 is attached to the second end of the bar 22. The first end of the clip 31 is connectedd to the second end of the bar 22 by a hinge 32. The clip 30 has an intermediate portion 33 which has a configuration complementary to the column of the intravenous stand 17. The second end of the clip 34 has a hook 35. On the second end of the bar 22, adjacent to the clip 30, there is a latch 36. The latch has a latch hook 37 and a pivotal member 38. The clip 30 is disposed so the intermediate portion 33 encompasses the column of th eintravenous stand 17, the hook 35 is engaged with the latch hook 37 and the pivotal member 38 is adjusted to securely clamp the column 17 to the second end of the bar 22. This supports the intravenous stand and prevents inadvertent movement during use of the stand. It also provides stability to the stand during transport of the patient carrier apparatus.

Figure 11:
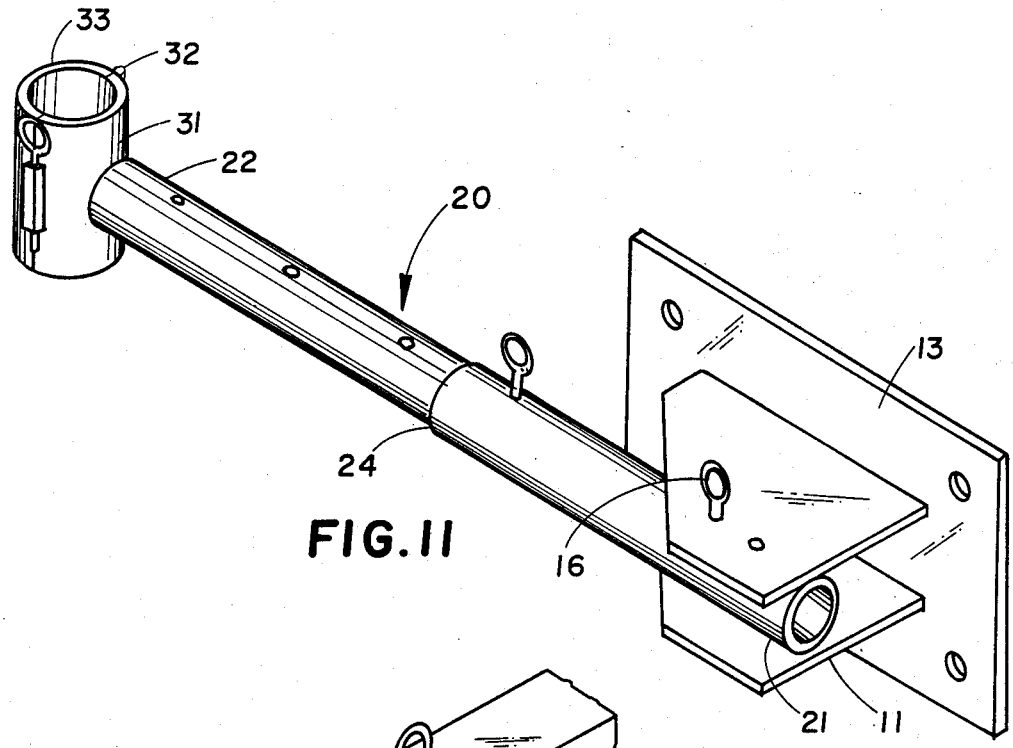
FIG. 11 is a perspective view of another embodiment of the device showing the bar in the storage position.
Figure 9:
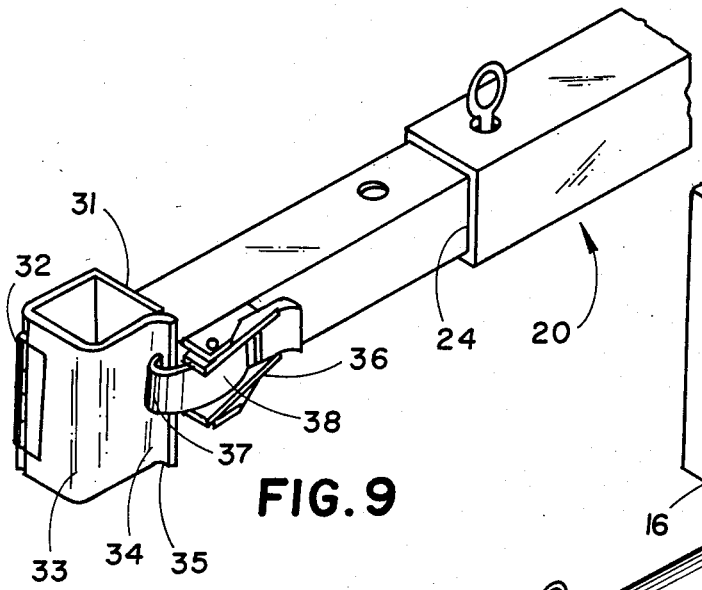
FIG. 9 is a perspective view showing the telescoping embodiment of the bar.
Figure 10:
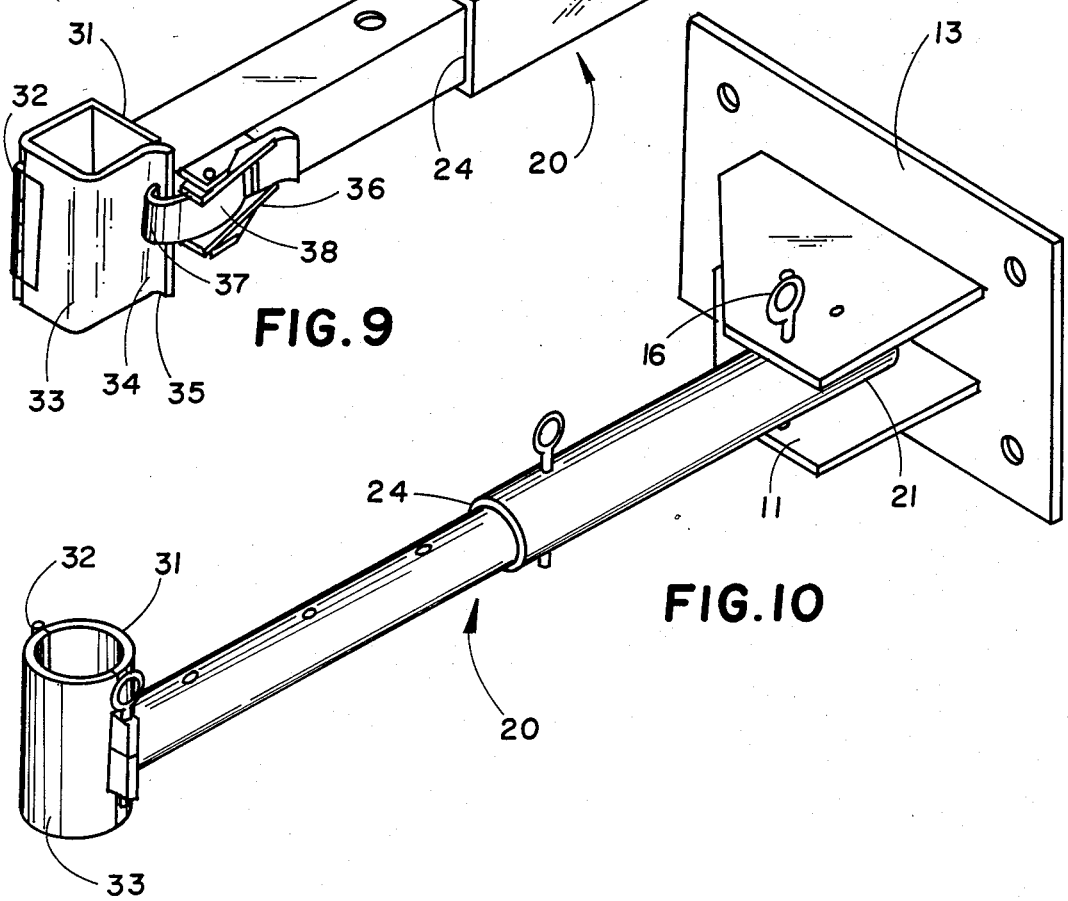
FIG. 10 is a perspective view of another embodiment of the device showing attachment of the flange to the frame means with the bar in the use position.

In an alternate embodiment, as shown in FIGS. 9–11 the bar may telescope to provide additional flexibility to the device 10.

FIGS. 10–11 show still another embodiment. The bracket means 11 provides for storage of the bar 20 substantially flat against the frame means 12 and permits movement of the bar 20 though at least a first position.

Figure 12:
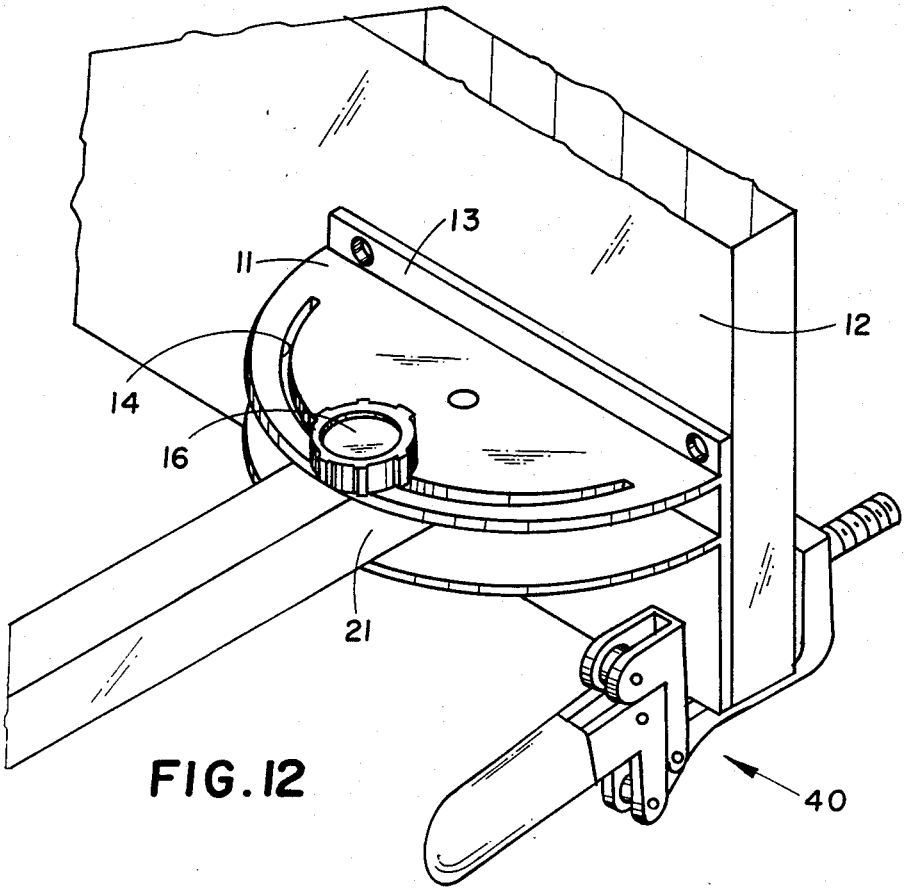
FIG. 12 corresponds substnatially to FIG. 4 but shows the use of a cam actuated "C" clamp to easily and rapidly mount the attachment device to the frame means of the patient support apparatus.
Figure 13:
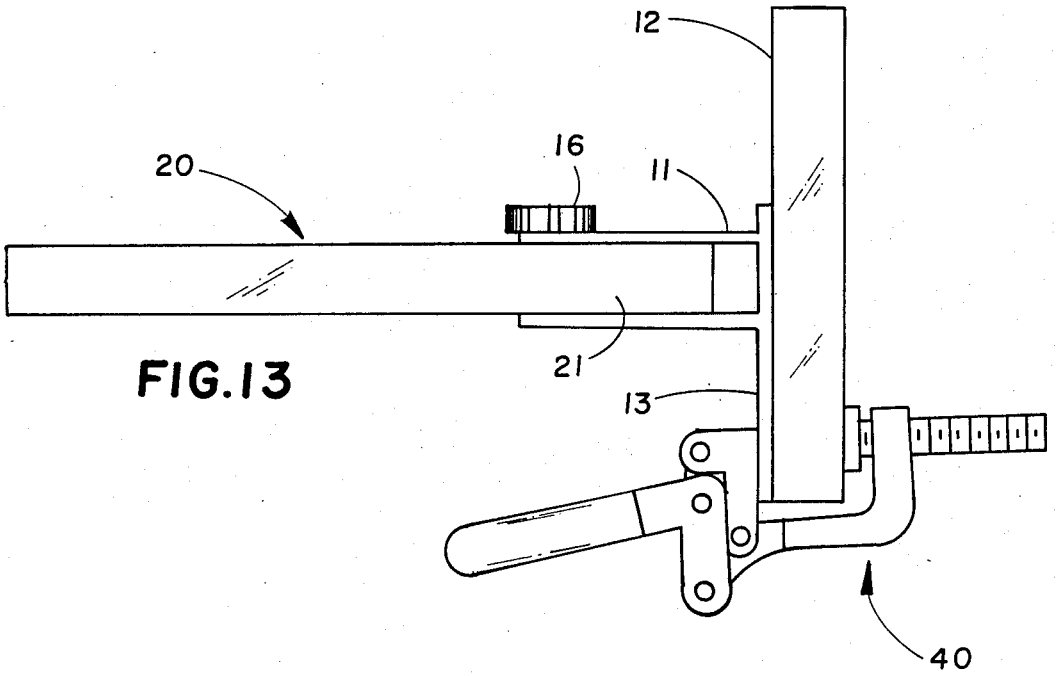
FIG. 13 is a side elevation corresponding to FIG. 4 and showing the use of a cam actuated "C" clamp for mounting the device.
Figure 18:
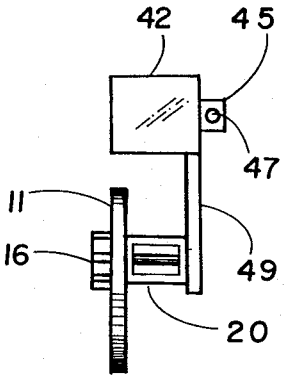
FIG. 18 is an end view of clamping mechanism showing the mounting of the bracket means to the first channel member.
Figure 17:
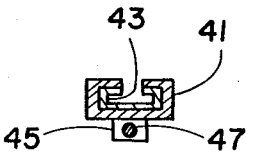
FIG. 17 is a cross-sectional view taken across line 17—17 of FIG. 16.
Figure 15:
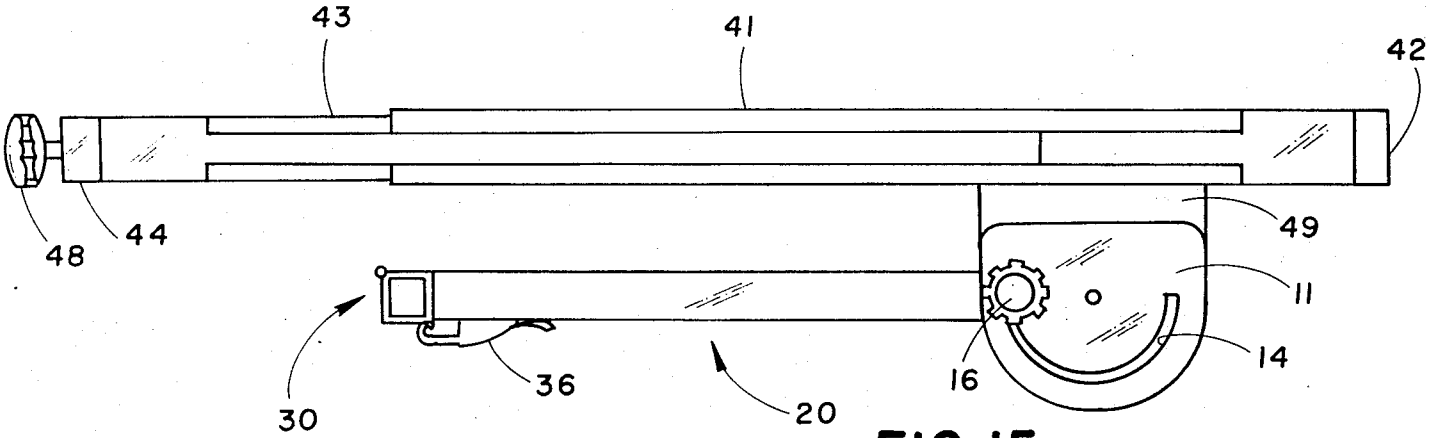
FIG. 15 is a plaln view of the embodiment shown in FIG. 14 showing the device mounted on the stretcher or gurney.
Figure 16:
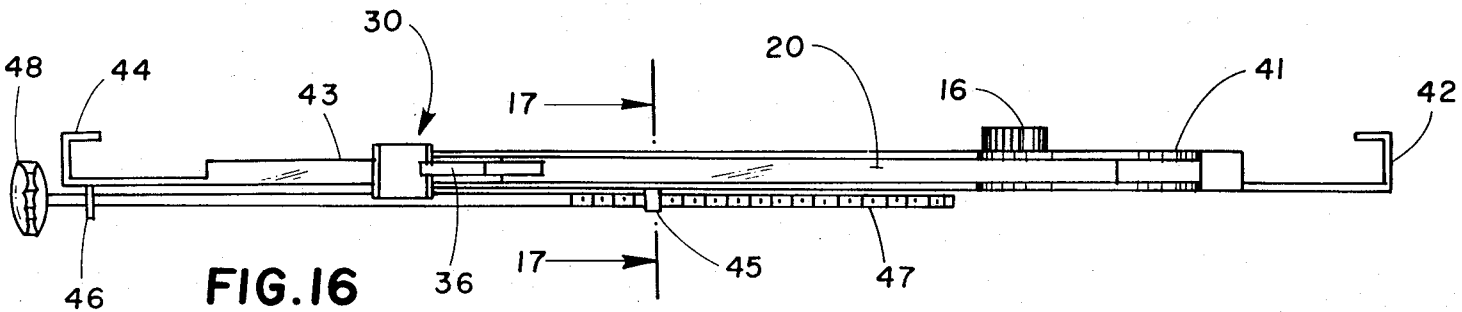
FIG. 16 is a side elevation view of the embodiment shown in FIG. 14.

In another embodiment, as in FIGS. 12–13, the means for attaching the device to the frame means of the patient support apparatus is a removable clamp 40 such as a conventional or modified cam actuated "C" clamp. A clamp which has been used satisfactorily is Model 325 made by De-Sta-Co., Troy, MI.

FIGS. 14–18 show another embodiment in which the device is mounted on a stretcher or gurney 50. A first open channel member 41 having a "J" shaped end 42 is slidably mounted about a second open channel member 43 having a "J" shaped opposite end 44. A threaded nut 45 is mounted on the outside of the first channel 41 and an eyelet 46 is mounted near the "J" shaped end 44 of the second channel 43. A threaded rod 47 having a knurled knob 48 at one end extends through the eyelet 46 and cooperates with the threaded nut 45 such that rotation of the knob 48 causes the channel members 41, 43 to slide in opposite directions. The "J" shaped ends 42, 44 are engaged on the frame of the stretcher 50 and the knob 48 is rotated to tighten the "J" shaped ends 42, 44. The bracket 11 of the device is attached to the first channel member 41 by a frame 49 extending from the first channel member 41.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A device for attaching a column of an intravenous stand to a frame means of a patient support apparatus or the like comprising:

a bracket means attached to the frame means of the patient support apparaus such that the bracket means extends outwardly and substantially horizontally;

a bar having a first end and a second end;

means for mounting the first end of the bar to the bracket means, such that the bar may be folded substantially flat against the frame of the patient support apparatus in a storage position when not in use, and such that the bar may be extended in a horizontal plane about a verical axis to a least a first position outwardly therefrom when in use to accommodate needs and available space; and means for releasably clamping the second end of the bar to the column of the intravenous stand, thereby rigidly and removably supporting the intravenous stand in a substantially vertical position at all times at a desired position with respect to the patient support apparatus and preventing inadvertent movement of the intravenous stand during use thereof.

2. The device of claim 1, wherein the bracket means has a flange substantially at right angles to the bracket means for attachment to the frame of the patient support apparatus.

3. The device of claim 1, wherein the patient support apparatus is a bed.

4. The device of claim 1, wherein the means for mounting the first end of the bar to the bracket means comprises:

the bar having an opening near the first end thereof;

the bracket means having a substantially arcuate slot therein; and a bolt passing through the arcuate slot and received in the opening in the bar such that the bar may be adjustably mounted approximately flat against the frame of the patient support apparatus and may be extended approximately 180° therefrom and the bar may be secured in all desired intermediate positions therebetween.

5. The device of claim 4, wherein the bolt is threaded and has a manually turnable head.

6. The device of claim 1, wherein the releasable clamping means comprises:

a spring clip having a first end and a second end, the first end being hingably connected to the second end of the bar, the clip extending laterally therefrom, the clip having a configuration complementary to the column of the intravenous stand, and the clip further having a hook on the second end; and a spring latch mounted on the second end of the bar adjacent to the spring clip, the latch having a latch hook to engage the hook on the spring clip thereby clamping the bar to the column of the intravenous stand.

7. The device of claim 1, wherein the bar is a telescoping bar and is adjustable in length.

8. The device of claim 1, wherein the bracket means is attached to the frame means of the patient support apparatus such as a gurney by an adjustable clamping mechanism comprising:

a pair of slidably nested channel members each having a means for engaging the frame of the gurney;

means for manually sliding the nested channel members such that the channel members may be extended and retracted; and means for attaching the bracket means to the channel members.

9. A device for attaching a column of an intravenous stand to a frame means of a patient support apparatus or the like comprising:

a bracket means attached to the frame means of the patient support apparatus such that the bracket means extends outwardly and substantially horizontally;

a bar having a first end and a second end;

means for mounting the first end of the bar to the bracket means, such that the bar may be folded substantially flat against the frame of the patient support apparatus in a storage position when not in use, and such that the bar may be extended to at least a first position outwardly therefrom when in use;

means for releasably clamping the second end of the bar to the column of the intravenous stand, thereby supporting the intravenous stand on the patient support apparatus and preventing inadvertent movement of the intravenous stand during use thereof;

wherein the bracket means is attached to the frame means of the patient support apparatus such as a gurney by an adjustable clamping mechanism comprising:

a pair of slidably nested channel members each having a means for engaging the frame of the gurney;

means for manually sliding the nested channel members such that the channel members may be extended and retracted; and means for attaching the bracket means to the channel members; wherein the bracket means is attached to the frame means of the patient support apparatus by an adjustable clamping mechanism comprising:

a first open channel shaped member having a first end and a second end, the second end having a J-shaped portion;

the first channel shaped member further having an inside and an outside;

a second open channel shaped member having a first end and a second end, the first end of the second member slidably mounted inside the first end of the first channel shaped member and the second end of the second channel shaped member having a J-shaped portion;

a threaded nut mounted on the outside of the first channel shaped member;

an eyelet mounted near the second end of second channel member adjacent to the J-shaped portion;

a threaded rod having a knurled knob at a first end, the rod extending through the eyelet and further having a second end cooperating with the threaded nut on the outside of the first channel member;

a frame extending from the first channel member for attachment of the bracket means;

such that the threaded rod may be adjusted to extend the channel shaped members such that the J-shaped portions may engage the frame means of the patient support apparatus and the threaded rod may be further adjusted to securely clamp the channel members to the frame means.

10. A device for attaching a column of an intravenous stand to a frame means of a patient support apparatus or the like comprising:

a bracket means having a flange substantially at right angles to the bracket for attachment to the frame of the patient support apparatus such that the bracket means extends outwardly and substantially horizontally;

the bracket means having a substantially arcuate slot therein;

a bar having a first end, a second end and an opening near the first end thereof;

means for mounting the first end of the bar to the bracket means;

a bolt passing through the arcuate slot in the bracket means and received in the opening in the bar such that the bar may be adjustably mounted approximately flat against the frame and may be extended in a horizontal plane about a vertical axis approximately 180° therefrom and the bar may be secured in all desired intermediate positions therebetween;

a spring clip having a first end and a second end, the first end being hingably connected to the second end of the bar, the clip extending laterally therefrom, the clip having a configuration complementary to the column of the intravenous stand, and the slip further having a hook on the second end; and a spring latch mounted on the second end of the bar adjacent to the spring clip, the latch having a latch hook to engage the hook on the spring clip, thereby clamping the bar to the column of the intravenous stand and supporting the intravenous stand in a substantially vertical position of all times at a desired position with respect to the patient support apparatus.

11. A device for attaching a column of an intravenous stand to a frame means of a patient support apparatus or the like comprising:

a bar having a first end and a second end;

means for mounting the first end of the bar to the patient support apparatus;

means for releasably clamping the second end of the bar to the column of the intravenous stand comprising:

a spring clip having a first end, a second end, and an intermeidate portion therebeween, the first end being hingably connected to the second end of the bar, the clip extending laterally therefrom, the intermediate portion having a configuration complementary to the column of the intravenous stand such that when the column of the intravenous stand is positioned adjacent to the second end of the bar, the spring clip may be hingably disposed such that the intermediate portion of the clip encompasses the column of the intravenous stand and the second end of the clip extends substantially around the column, the clip further having a hook on the second end;

a spring latch mounted on the second end of the bar adjacent to the spring clip, the latch having a latch hook to engage the hook on the spring clip, the latch further having a pivotally attached member attached to the latch hook such that when the latch hook is engaged with the hook on the spring clip, the pivotally attached member may be positioned to clamp the spring clip about the column of the intravenous stand thereby supporting the intravenous stand on the patient support apparatus and preventing inadvertent movement of the intravenous stand during use thereof.

12. The device of claim 11, wherein the clamp means has a non-slip coating thereabout such that the column of the intravenous stand is securely held in the clamp and damage to the intravenous stand is reduced.

13. The device of claim 12, wherein the non-slip coating is a high density foam rubber.

14. A device for attaching a column of an intravenous stand to a frame means of a patient support apparatus or the like comprising:

a bar having a first end and a second end;

means for mounting the first end of the bar to the frame means of the patient support apparatus such that the bar may be folded substantially flat against the frame of the patient support apparatus in a storage position when not in use, and such that the bar may be extended in a horizontal plane about a vertical axis to at least a first position outwardly therefrom when in use to accommodate needs and available space; and means for releasably clamping the second end of the bar to the column of the intravenous stand, thereby rigidly and removably supporting the intravenous stand in a substantially vertical position at all times at a desired position with respect to the patient support apparatus and preventing inadvertent movement of the intravenous stand during use thereof.

* * * * *